US005123358A

United States Patent [19]

Kemppainen et al.

[11] Patent Number: 5,123,358

[45] Date of Patent: Jun. 23, 1992

[54] BOGIE CONSTRUCTION OF A RAILWAY CAR

[75] Inventors: Markku Kemppainen, Oulu; Ossi Kahra, Kangasala; Aki Kauhanen, Oulu, all of Finland

[73] Assignee: Rautaruukki Oy, Oulu, Finland

[21] Appl. No.: 527,128

[22] Filed: May 22, 1990

[30] Foreign Application Priority Data

May 24, 1989 [FI] Finland ..... 892542

[51] Int. Cl.[5] ..... B61F 3/00

[52] U.S. Cl. ..... 105/167; 105/218.2; 105/199.1; 105/453

[58] Field of Search ..... 105/165, 167, 168, 169, 105/176, 179, 199.1, 199.3, 199.5, 206.1, 218.2, 223, 453

[56] References Cited

U.S. PATENT DOCUMENTS

| | | | |
|---|---|---|---|
| 3,528,374 | 9/1970 | Wickens | 105/168 |
| 3,692,325 | 9/1972 | Gouirand | 105/453 |
| 3,806,148 | 4/1974 | Boulton | 105/218.2 |
| 3,945,325 | 3/1976 | Zehnder | 105/167 |
| 3,948,188 | 4/1976 | Zehnder | 105/167 |
| 4,478,153 | 10/1984 | Eggert, Jr. | 105/168 |

FOREIGN PATENT DOCUMENTS

| | | | |
|---|---|---|---|
| 0161729 | 11/1985 | European Pat. Off. . | |
| 0165752 | 12/1985 | European Pat. Off. . | |
| 0718395 | 3/1942 | Fed. Rep. of Germany | 105/218.2 |
| 2422825 | 1/1975 | Fed. Rep. of Germany . | |
| 2631350 | 2/1977 | Fed. Rep. of Germany . | |
| 2842211 | 4/1980 | Fed. Rep. of Germany . | |
| 3235692 | 4/1983 | Fed. Rep. of Germany . | |
| 76296 | 6/1988 | Finland . | |
| 0304164 | 5/1971 | U.S.S.R. | 105/218.2 |

*Primary Examiner*—George E. A. Halvosa
*Assistant Examiner*—Mark T. Le
*Attorney, Agent, or Firm*—Spensley Horn Jubas & Lubitz

[57] ABSTRACT

A bogie for a railway vehicle comprising of at least two articulated, pivotable and rotatable wheel body parts (2, 3) including wheels or a set of wheels (4, 5) mounted in bearings and the supporting body (6) of the bogie being connected to the parts by a suspension (**9*a*, 9*b*) of the railway vehicle. In the bogie, two wheel body parts (2, 3) have been resiliently interconnected from their side constructions by two stabilizer constructions (16) both of which have been articulated to the supporting body (6**).

13 Claims, 5 Drawing Sheets

BOGIE CONSTRUCTION OF A RAILWAY CAR

BACKGROUND OF THE INVENTION

1. Field of the Invention:

The invention relates to a bogie for a railway vehicle.

2. Related Art:

Bogie constructions currently used in railway vehicles such as engines and cars or other similar vehicles are usually such that the body construction of the bogie is stiff with the wheel sets affixed to it. A stiff bogie body entails many drawbacks, one of the most significance of which shows up when moving through curves. Since the bogie body is stiff, the wheel sets of the bogie are not able to move radially in the curve, causing the wheels of the set to wedge against the rails which causes extreme wearing of the wheels and rails. Such a wedging makes e.g. a part of the engine's pull force "vanish" in the curve resistance. Riding through curves with such a railway vehicle with a stiff body is possible only by using an axial clearance between the bearing housing and the bogie body (construction type Y25). When driving straight, this kind of bogie construction behaves well, but in curves it will "push" as described above. The construction can be modified by making the wheel sets clearly self-steering with each axle adapting to the direction of the rails regardless of the other axles (construction 65sd). Said construction functions well with small speeds both in curves and when riding straight, but when the speed increases, a vibration (so called hunting) will occur around the vertical line against the centre line of the axle. This makes the use of such bogies unstable and even dangerous when riding with high speeds.

Various solutions have been tried in order to avoid the drawbacks described above. For example, in the publications FR-76296, US-4 478 153, EP-165752, EP-161729 and US-3 528 374, different bogie constructions have been described where the bogie body has been divided into two parts and articulated in the middle so that the wheel sets are able to rotate with respect to each other and thus follow the curves according to the curve radius, i.e. radially. Typical to all radially controlled bogie constructions is that they are explicitly steered on the basis of the curve radius when the steering is based e.g. on the mechanical observation of the angle difference between the bogie and the car body and on the conversion of the angle difference to an angle difference of the two bogie parts equivalent to the curve radius. Generally it is a question of a mathematical problem of changing a known quantity into another prescribed quantity. Only the mechanisms, with which this is carried out in the said publications, differ from each other. These constructions have a drawback of making the constructions complicated, expensive and heavy, as can be seen in the said publications. E.g., in the publication FI-76296, a rod connecting the bogies prevents the efficient use of the space between the bogies for loading. When using a fluid coupling of the publication US-3 528 374 between the bogies, the said space can be exploited, but the construction will be expensive to service and will damage easily.

When using the construction of 4 478 153 where the sets of wheels are not mechanically controlled, but are allowed to be steered by elastic elements, the characteristics lie somewhere between the mechanically controlled bogies and freely controlled sets of wheels. By extending the axial distance of the bogie, a better riding stability can be achieved, but the bigger bogie size will take otherwise usable space between bogies.

If it is desirable to make the loading space of a freight car as big as possible, the bogies must be built as short as possible, which means that the riding characteristics will become worse or that the steering of the bogie parts will become more complicated. When it is desired to maximize the transport space, the supporting constructions of the car must be made as small as possible, which would require extending the side frames to the sides of the bogie. This again means that, deviating from the traditional practice, the bearing and cushioning of the bogies must be made inside the wheels. Even if the side frames were not extended to the sides of the bogie, concerning the articulated two-part bogies, at least the cushioning must be placed inside the wheels, because loading through the springs must be brought in vertical plane through the axial line of the wheels in order to avoid moment in the bogie joint or to avoid an extremely complicated construction. As a result of this, the car itself will lean considerably in the curves since the bearing distance of the springs will narrow in the lateral direction of the car.

The above-mentioned problems will still become emphasized in situations occurring frequently in railways, i.e. in situations where, because of the roughness of the railway e.g. one of the bogie wheels rises higher or falls lower than the other wheels; this can happen e.g. on railway yards at gearings or when approaching a curve (when the outer rail of the curve will rise with respect to the inner rail) or when leaving a curve (when the outer rail will fall with respect to the inner rail). The two parts of the bogie will then twine with respect to each other about the longitudinal axis of the car. Additionally because of the turning by the curve and the tendency to incline caused by the centrifugal force, it must be stated that no known solution provides a satisfactory riding result. It can of course be imagined that the technical knowledge of the various publications, e.g. the inclination suppressor of DE-2 422 825, be connected to the said bogie constructions. In principle, it should then be possible to achieve a functional construction, but it would be so complicated, heavy, demanding of a lot of service and expensive that it would not be realistic.

SUMMARY OF THE DISCLOSURE

An object of embodiments of the invention is thus to provide a bogie for a railway vehicle comprising radially controlled interconnected sets of wheels, i.e. wheel sets being self-steerable and not mechanically controlled and suited for fast speeds without inconvenient phenomena.

An object of embodiments of the invention is further to provide a bogie construction where the part supporting the car body is cushioned with respect to the bogie body and which is movable to the bogie body also in horizontal directions but with which the inclination of the car body by lateral acceleration or eccentric load can be limited as little as necessary in each case. An object of embodiments of the invention is in particular to provide a bogie construction where the inclination forces are divided equally on successive bogie wheels regardless of whether all the wheels are at the same level or situated at different heights. An object of embodiments of the invention is further to provide a construction where the brake gears and other similar controlling elements are mounted in such a way that they stay stable with respect to the wheels irrespective of the riding situation. Another object of embodiments of the invention is to provide a bogie construction with which it is possible to carry out the abovementioned objectives with a simple, reliable and costeffective construction.

With the bogie construction according to an embodiment of the invention, it is possible to achieve a crucial improvement in the abovementioned drawbacks and to realize the objectives described above. In order to achieve this, the device of an embodiment of the invention is characterized with the distinctive features of claim 1.

One advantage of embodiments of the invention can be seen in that it is possible to provide a bogie construction operating well, even at fast speeds, without the difficulties of curve drive of a stiff bogie and without the complicated construction of a mechanically controlled bogie. Another advantageous feature is that embodiments of the invention enables the use of a bogie with a small axle distance and an inner body bearing and cushioning simultaneously with even wheel loads and as little car inclination as desired. Another advantage of embodiments of the invention is that the bogie construction can be made small in size, light and constructionally simple and reliable; hence, the useful capacity of the car can be extended due to the decrease in the bogie size and to the possibility of making different kinds of side constructions.

BRIEF DESCRIPTION OF DRAWINGS

Embodiments of the invention will next be described in more detail referring to enclosed drawings where.

DESCRIPTION OF THE PREFERRED EMBODIMENT

Figure 1:
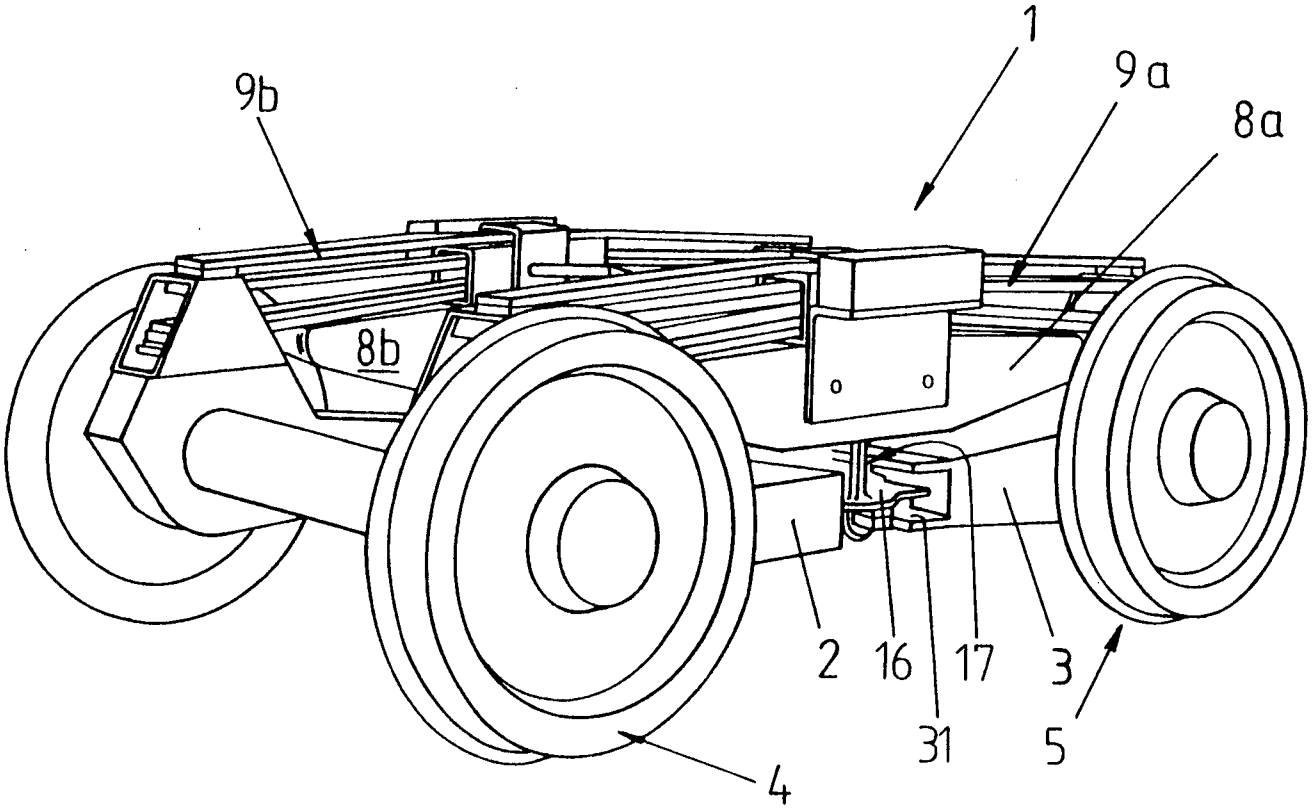
FIG. 1 is a perspective diagrammatical side-view of a bogie construction according to an embodiment of the invention.
Figure 2:
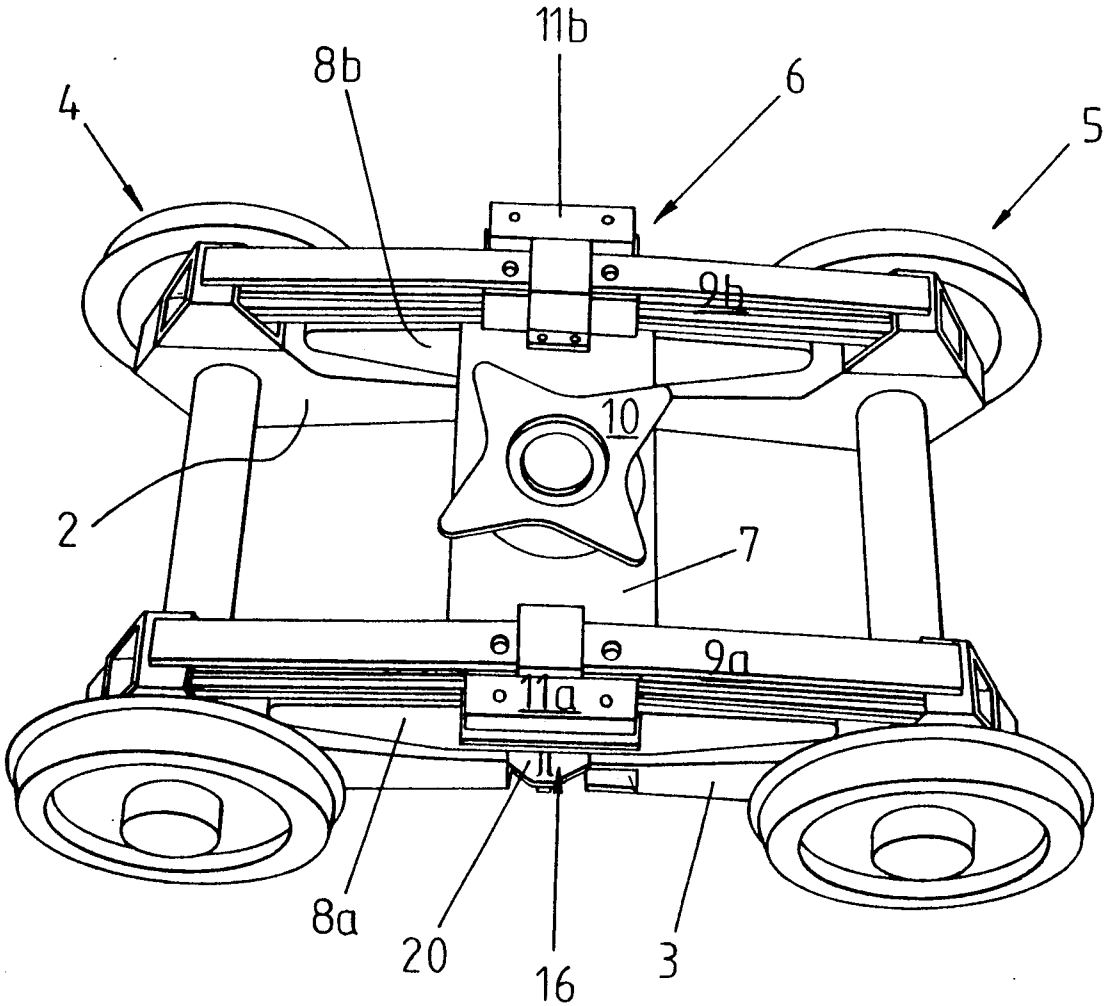
FIG. 2 is a diagrammatical perspective view of the construction of FIG. 1 seen from above.

FIG. 1 shows in general view the bogie 1 of an embodiment of the invention comprising two wheel body members 2 and equipped with a set of wheels 4 and 5. FIG. 2 shows a supporting body 6 comprising a cross member 7 and side frames 8*a* and 8*b*. The side frames 8 and the cross member 7 are stiffly connected to each other and rest on springs or spring bulks 9*a*, 9*b*on the wheel bodies 2 and 3 so that the load force of the car is directed through the springs to the members of the wheel body at least approximately in vertical plane through the axle line of the sets of wheels allowing thus the movement of the wheel body in horizontal plane with respect to the springs. The car body, which is not shown in the figures, is connected to the bogie centre 10 on the cross member 7, the centre being of a standard type construction. When the car inclines, it meets the side supports 11*a*, 11 *b*.

Figure 3:
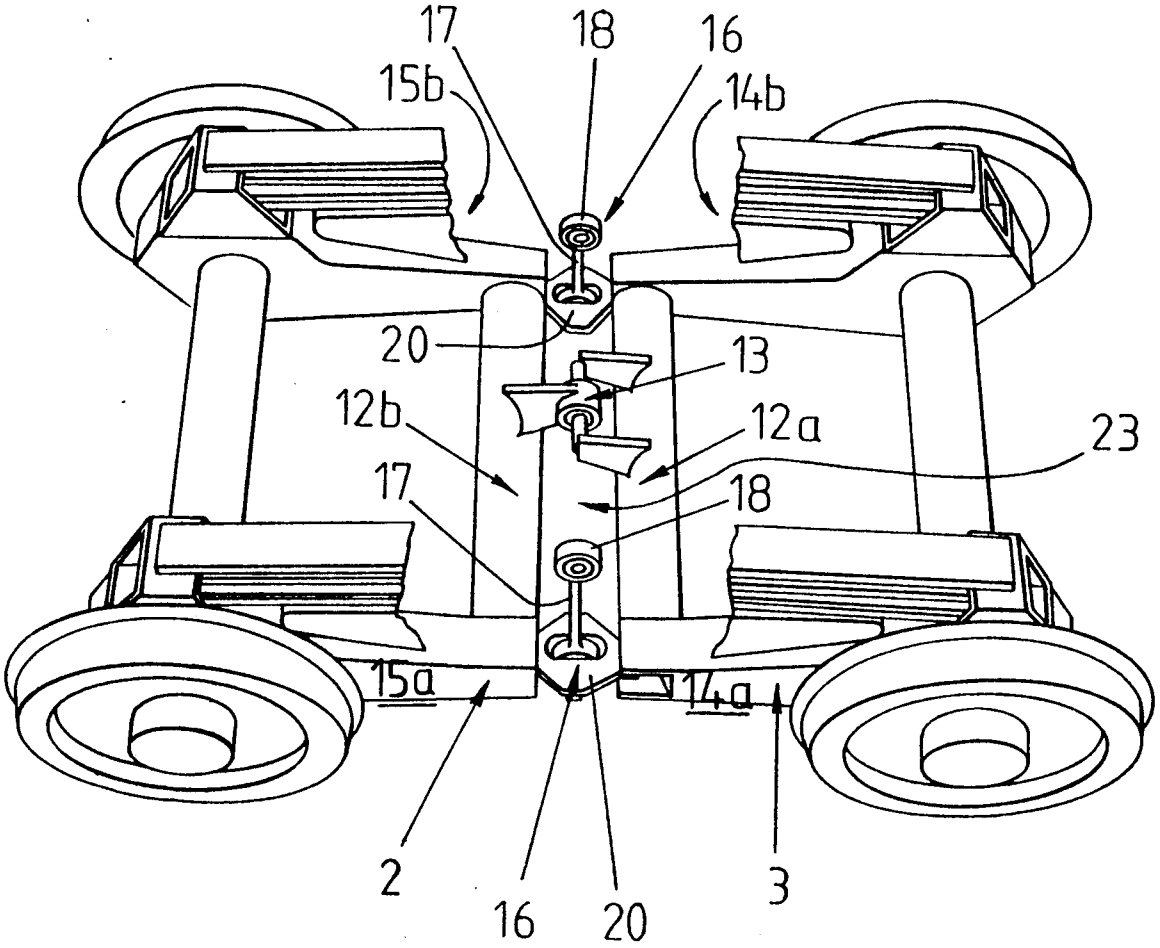
FIG 3 shows the construction of the FIG. 2 from the same direction but partly opened.

FIG. 3 shows the wheel bodies 2 and 3 both of which are formed mainly e.g. by a horizontal U-form body element with side members 14*a*, 14*b* and 15*a*, 15*b*, respectively, and a lateral base member 12*a* and 12*b*, respectively. The body elements have been interconnected by a link 13 from their base members 12*a* and 12*b* through the middle line of the car. The said connecting link 13 has been constructed so that it lets the wheel body members 2 and 3 turn with respect to each other both horizontally and vertically; further, it allows the rotation of the wheel body parts 2 and 3 with respect to each other about the longitudinal axis of the car. Such link constructions are numerous, and they can also consist of links and bars; some of these constructions have been described in the said reference publications; hence, they will not be explained in more detail here. The wheel sets 4 and 5 or respectively the wheels have been stiffly mounted in bearings to the branches 14*a*, 14*b*, 15*a*, 15*b* of each of the U-form body bars so that the rolling direction will follow the direction of the branches. Thus the wheel body parts 2 and 3 form a bogie construction with the connected, radially controlled wheel sets.

According to the invention, the wheel body parts 2 and 3 have been connected in the vicinity of the other side pair 14*a*, 15*a* of the U-form body elements and in the vicinity of the other side pair 14*b*, 15*b* resiliently with each other by two essentially similar stabilizer constructions which have generally been described with the reference number 16. The said two stabilizer constructions 16 have further been articulated to the side frames 8*a* and 8*b* of the supporting body 6. Each of the stabilizer constructions has been constructed so that, examining the movement of the wheel set parts 2 and 3 with respect to each other, it enables the movement of said side edges 14*a* and 15*a* or 14*b*, 15*b* respectively at least somewhat with respect to each other both vertically and in the direction of motion of the bogie. Each of the stabilizer constructions has been affixed to the side frames 8*a*, 8*b* of the supporting body 6 so that the supporting body 6 and the wheel body members 2, 3 can move laterally with respect to each other. The said construction combination enables the connecting link 13 to be sensitive and without stiffening constructions.

The illustrated construction embodiment operates in the following way:

When a railway vehicle drives around a curve, the centrifugal force tends to turn the car body about the bogie centre 10 when the car body abuts against the side support 11*a* or 11*b*. Without any stabilizer construction, the spring on the outer side of the curve would then sink and the spring on the inner side of the curve would rise, thus causing the inclination of the car body towards the outer edge of the curve. However, the stabilizer construction according to the invention prevents this by transferring e.g. the force applied downwards to the side frame from the support 11*a* or 11*b* from the side frame 8*a* or 8*b* equally to the wheel members 2 and 3 through the stabilizer construction and through the said base members 12*a* and 12*b* into the width of the body element. Because the base members 12*a* and 12*b* are, due to the stabilizer constructions 16, stiff with respect to the cross-directional moment and because of the construction is stiffly fastened the support body side on the side of the outer curve is not able to sink nor can the support body side on the side of the inner curve rise, , i.e. the stabilizer constructions 16 create a suppressor for the inclination.

Because the wheel body parts 2 and 3 are able to turn horizontally with respect to each other, the said radial self-steerability of the wheel set can be maintained. Because the wheel set parts 2 and 3 can turn with respect to each other about the horizontal axis via the connecting joint 13, a flexible movement independent of inclination or its suppression is possible when the side pair 14*a*, 15*a* and 14*b* and 15*b*, respectively, always yield the same amount because of the stabilizer constructions 16. Because the connecting joint 13 allows the wheel body parts 2 and 3 to twist longitudinally with respect to each other, which is also allowed by the stabilizer constructions 16 because of their elasticity and links, the wheel sets 4 and 5 can adjust to the roughness and winding of the rails. By providing the stabilizer construction 16 with proper resilience or other suppression, it is possible to control the steerability, and to operate the bogie in a desired way, i.e. fulfilling all the demands in practice. Because it is thus possible to control the inclination and motion precisely in the desired way, dimensions of the bogie can be reduced, and the springs and bearings can be placed inside the wheels which makes the whole bogie construction smaller. The space thus saved can be utilized in the car body. As an additional advantage, the brake mechanisms can be fastened to the wheel body parts so that they keep their exact position with respect to the wheels irrespective of the riding conditions.

As a summary of the operation of the stabilizer constructions 16 it can still be said that they lead to the equal division of the loading caused by the weight of the car body on both wheel body members 2, 3. Also, the centrifugal force caused by the curve is divided equally on two successive wheels in the bogie, thus preventing the inclination of the car body. The above-mentioned characteristics stay the same irrespective of the roughness of the railway, i.e. irrespective of whether the wheel body parts 2 and 3 are twisted with respect to each other.

One construction of the stabilizer 16 of an embodiment of the invention is next described in more detail. The stabilizer construction has been presented in more detail in FIG. 4, which corresponds to the stabilizer construction which has been presented diagrammatically in the FIGS. 1–3. As described above, each bogie includes two stabilizer constructions 16, one on each side of the bogie.

In this embodiment, the stabilizer construction 16 is principally formed by a vertical reaction bar 17 which has been fastened with a link 18 to the outer edge or lower part of the longitudinal beams 8*a* or 8*b* of the support body. One end of the reaction bar 17 is, in this embodiment connected with another link 19 mainly to a horizontal, rod-like or sheet-like compensator 20, and more exactly, in the middle of the compensator. The compensator 20 extends on both sides of the wheel bodies inside (or by) the branches 14*a* and 15*a* and 14*b* and 15*b*, respectively, so that the bar 17 is situated in the middle of these and longitudinally approximately in the middle of a gap 23 when the wheel sets are at rest and parallel. Elastic constructions 25*a*, 25*b* formed by two spring units 21*a*, 21*b* are placed inside the side members 14*a*, 15*a*, 14*b*, 15*b* or to a respective point so that the compensator 20 extends between the spring units 21*a*, 21*b*and is pressed by them. The spring units 21*a*, 21*b* are fixedly mounted by elements 22 to the said side member of the wheel body. Side members 14*a*, 15*a*, 14*b*, 15*b* of the wheel bodies comprise holes 31 or similar members opening toward the gap 23 between the wheel bodies 2 and 3 with the said spring units 21*a*, 21*b* being placed in said gaps so that they press the compensator 20 between them approximately in the longitudinal direction of the reaction bar 17. This enables the movement of the compensator 20 in all horizontal directions by its sliding between the faces 24*a*, 24*b* of the units pointing towards each other, and thus allowing the compensator to incline around the apparent pivoted axles lying in the same horizontal plane. Thus the wheel body sides 14*a* and 15*a* and 14*b* and 15*b*, respectively, can draw away from or approach each other and move a little with respect to each other up or down when force extends from the parts of the wheel body as the bogie is steered according to the railway. The links 18 and 19 are responsible for maintaining the connection transmitting force on the reaction bar 17 to the longitudinal beams 8*a* and 8*b* which are stable with respect to the wheel body sides, whereas forces from the reaction bar 17, i.e. load and inclination forces, are divided by the compensator 20 equally to both parts 2 and 3 of the wheel body. Hence, the stabilizer construction transmits the forces from different directions forward in different ways.

Figure 4:
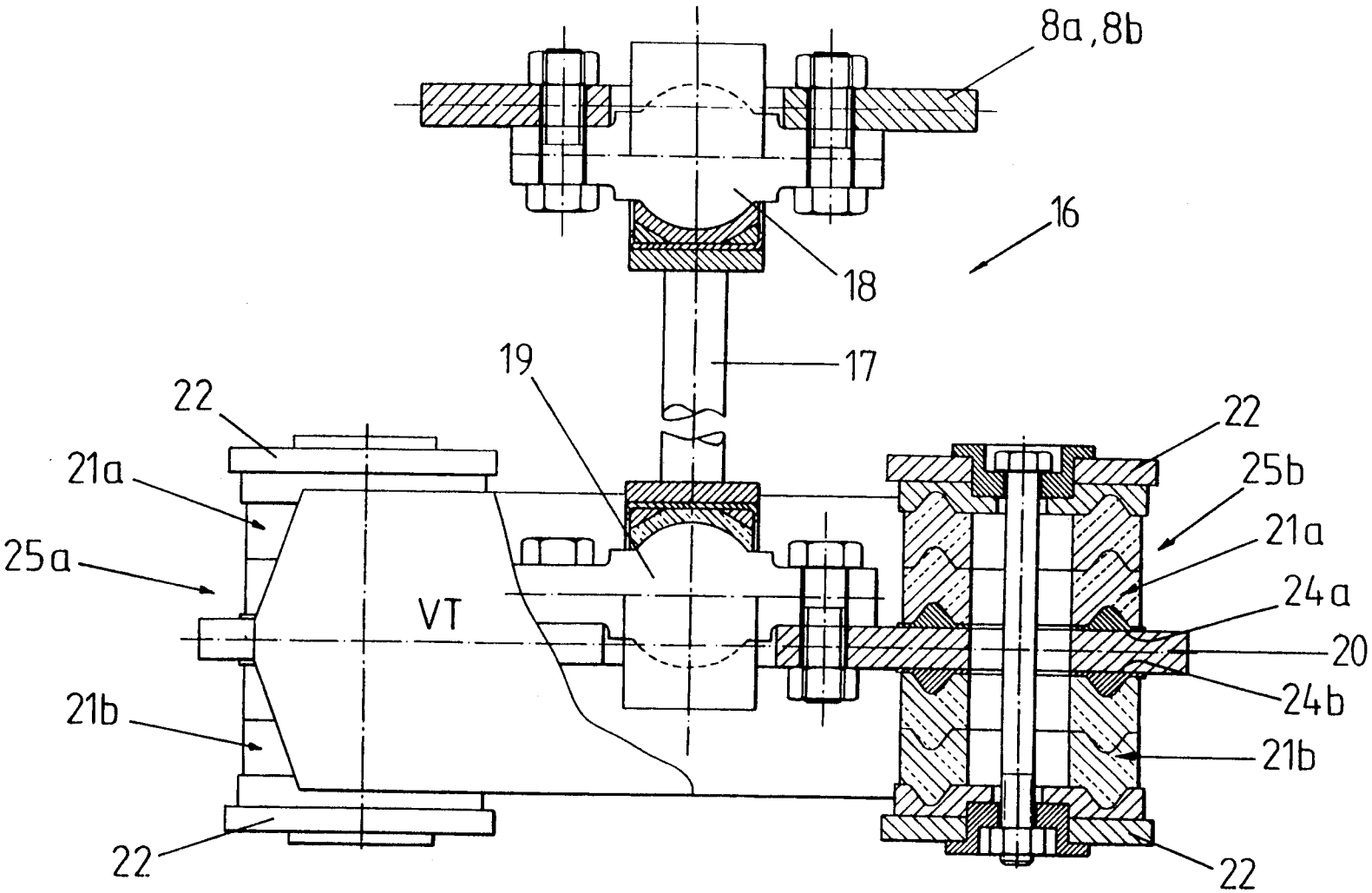
FIG. 4 shows an application of the stabilizer construction of an embodiment of the invention in more detail and partially in section and in side view.
Figure 5:
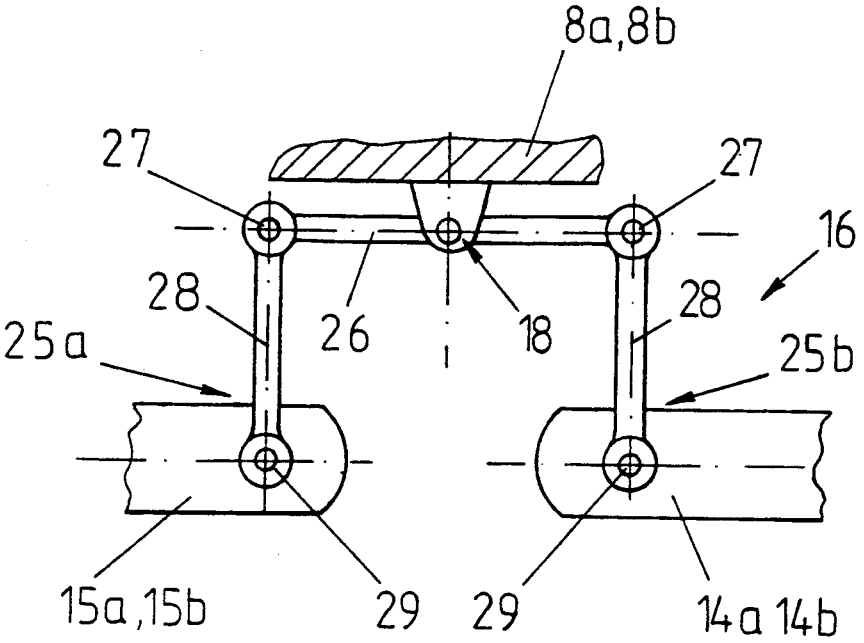
FIG. 5 shows another application of the stabilizer construction of the invention in diagrammatical side view.

FIG. 5 shows diagrammatically another application of the stabilizer construction where the same reference numbers indicate the same parts as above. In this application, the longitudinal beam 8*a* and 8*b* has been connected by a link 18 approximately to the middle of the reaction bar 26, and the ends of the bar 26 have been connected to the side members 14*a*, 15*a* and 14*b*, 15*b* of the wheel body by elastic constructions 25*a*, 25*b*. In this embodiment, the elastic construction 25*a*, 25*b* is formed by a link 27 fastened to the reaction bar 26 by an arm 28 extending to the bar 26 in an angle, advantageously approximately in right angle, and by links 29 connecting the arm 28 and the side members 14*a*, 15*a*, 14*b* and 15*b*. Also, this construction makes the same motions and operations possible as with the stabilizer construction of FIG. 4.

Figure 6:
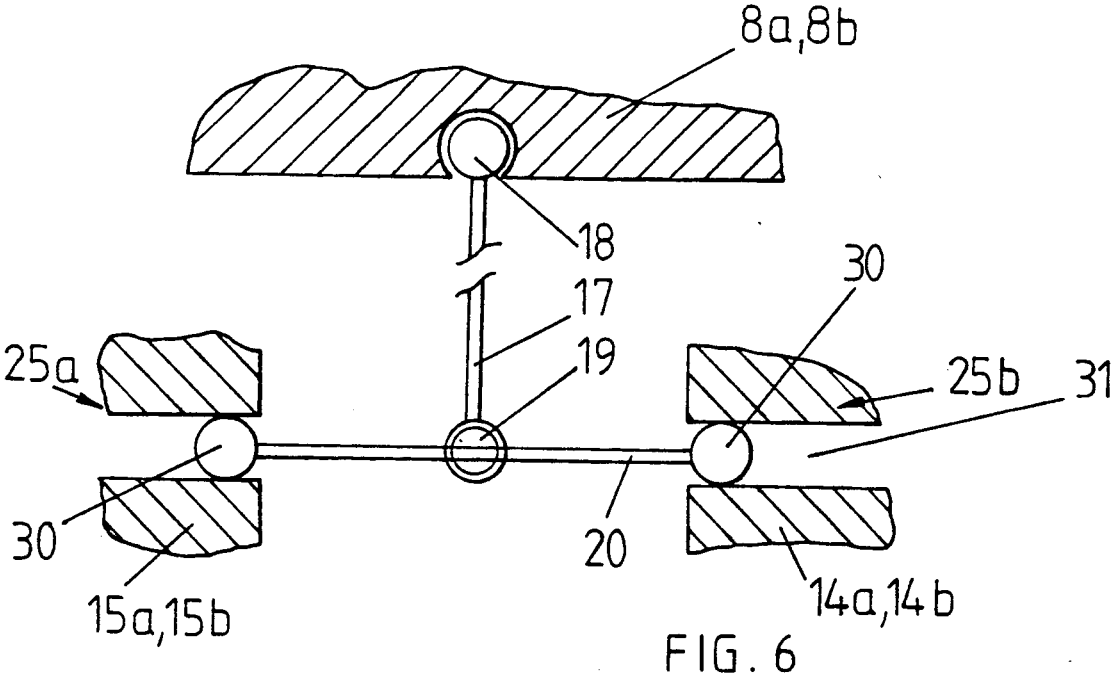
FIG. 6 shows still another application of the stabilizer construction of an embodiment of the invention in diagrammatical side view.

FIG. 6 presents a modification of the application of FIG. 4 where the same reference numbers indicate the same parts as above. In the application of FIG. 6, the links 18 and 19, the reaction bar 17 and the stabilizer 20 correspond with the parts of FIG. 4. Elastic constructions 25*a*, 25*b* have, in this embodiment, been changed to a construction where the compensator 20 projects e.g. inside the side members 14*a*, 15*a*, 14*b* and 15*b* and where the compensator end comprises a link construction allowing it to turn on all directions like a ball joint 30. As the ball joint has further been arranged horizontally slidable with respect to the side members 14*a*, 14*b*, 15*a*, 15*b*, it is possible to provide the same operations as with the constructions of FIGS. 4 and 5.

The difference between the application of FIG. 4 and those of FIGS. 5 and 6 is that the latter ones act as inclination stabilizers completely in a stiff manner, i.e. they do not allow any kind of inclination caused by the centrifugal force. The application of FIG. 4, on the other hand, allows a small inclination because the respective lower spring units 21*b* of the elastic constructions 25*a* and 25*b* in the adjacent side elements can simultaneously press together due to the force which is equally divided by the compensator 20 at the same time as the upper spring elements 21*a* get longer or vice versa. It is obvious that the elements enabling the resilience corresponding to the construction of FIG. 4 can easily be connected to the construction principles of FIGS. 5 and 6; these elements, which are not described more closely, can be fastened either to the links 27, 29, 30 or to the arms 28. Also the supporting link 18 and the connecting link 19 of the compensator can be disconnected, as well as the reaction bar 17, 26 and the compensator 20. Also, other suppressive elements can be used. The link 19 is not necessary for the operation of the device; it can be replaced by a stiff connection, i.e. the reaction bar 17 and the compensator 20 can be made of one piece however, this could result in considerably increased forces leading to an overly heavy and otherwise unadvantageous construction. Also, other combinations of rods and links besides the one being described can be developed.

Breaking devices are fastened to the wheel body 2, 3, and to a limiter construction between the wheel body parts 12*a*, 12*b* and the cross beam 7 transferring the deceleration forces from the supporting body to the wheel body. These constructions have not been described in the figures.

We claim:

1. A bogie for a railway vehicle comprising a supporting body, at least two wheel body parts, a connecting structure pivotally and rotatably supporting the wheel body parts, at least one wheel being mounted to each respective wheel body part, and the supporting body being connected to the wheel body parts by springs, characterized in that the wheel body parts have side constructions, and wherein a stabilizer construction resiliently interconnects the side constructions of the wheel body parts to each other and to the supporting body, the stabilizer construction comprises a reaction bar connected to the supporting body by a supporting link and to the side constructions of the wheel body parts by elastic constructions enabling the movement of the reaction bar in at least all horizontal directions and enabling all side constructions to twist with respect to each other, the elastic constructions are comprised of at least two spring units affixed to the side constructions of the wheel body parts, and a compensator is connected to the reaction bar, and is extended approximately perpendicular from the reaction bar and disposed between the spring units.

2. A bogie according to claim 1, c h a r a c t e r i z e d in that the reaction bar is connected to the compensator by a connecting link.

3. A bogie according to claim 1, c h a r a c t e r i z e d in that the spring units are comprised of rubber springs.

4. A bogie for a railway vehicle comprising a supporting body, at least two wheel body parts, a support structure pivotally and rotatably supporting the wheel body parts, at least one wheel being mounted to each respective wheel body part, and the supporting body being connected to the wheel body parts by springs, characterized in that the wheel body parts have side constructions, and a stabilizer construction resiliently interconnects the side constructions of the wheel body parts to each other and to the supporting body, the springs are connected to the wheel body parts and the stabilizer construction comprises a rigid reaction bar connected to the supporting body by a supporting link and to the side constructions of the wheel body parts by elastic constructions enabling the movement of the rigid reaction bar in at least all horizontal directions and enabling all side constructions to twist with respect to each other, wherein the elastic constructions are comprised of at least two spring units affixed to the side constructions of the wheel body parts, and a compensator is connected to the rigid reaction bar, and is extended approximately perpendicular from the rigid reaction bar and disposed between the spring units.

5. A bogie according to claims 4, c h a r a c t e r i z e d in that a connecting link connects the reaction bar to the compensator, and includes means for allowing the reaction bar to tilt in relation to the compensator.

6. A bogie according to claim 4, c h a r a c t e r i z e d in that the spring units are comprised of rubber springs.

7. A bogie according to claim 5, c h a r a c t e r i z e d in that the spring units are comprised of rubber springs.

8. A bogie for a railway vehicle comprising:

first and second wheel body parts;

a supporting body; and a support structure connecting the supporting body to the first and second wheel body parts, the support structure comprising:

a first spring connected to the first and second wheel body parts and connected to the supporting body at a location on the first spring between the connections to the first and second wheel body parts;

a first stabilizer construction connected to the first and second wheel body parts and connected to the supporting body, the first stabilizer construction having a substantially rigid bar connected to the supporting body and a compensator member connected to the substantially rigid bar and to the first and second wheel body parts, wherein:

the substantially rigid bar has a first end connected to the supporting body and a second end opposite the first end, the compensator member is connected to the second end of the substantially rigid bar, the compensator member having a first portion extending on one side of the substantially rigid bar and connected to the first wheel body part, the compensator having a second portion extending on the opposite side to the one side of the substantially rigid bar and connected to the second wheel body part.

9. A bogie as claimed in claim 8, further comprising:

a first resilient connector resiliently connecting the first portion of the compensator member to the first wheel body part, and a second resilient connector resiliently connecting the second portion of the compensator member to the second wheel body part.

10. A bogie as claimed in claim 9, wherein the first resilient connector comprises a plurality of spring units including at least two spring units between which the first portion of the compensator member is disposed, and P1 wherein the second resilient connector comprises a plurality of spring units including at least two spring units between which the second portion of the compensator member is disposed.

11. A bogie as claimed in claim 8, wherein the compensator member comprises a rod extending substantially perpendicular to the substantially rigid bar, wherein the first portion comprises a first span of the rod on one side of the substantially rigid bar and the second portion comprises a second span of the rod on the opposite side to the one side of the substantially rigid bar.

12. A bogie as claimed in claim 8, wherein the compensator member comprises a sheet-like member extending substantially perpendicular to the substantially rigid bar, wherein the first portion of the compensator member comprises a first span of the sheet-like member on one side of the substantially rigid bar and the second portion of the compensator member comprises a second span of the sheet-like member on the opposite side to the one side of the substantially rigid bar.

13. A bogie for a railway vehicle comprising a supporting body, at least two wheel body parts, a connecting structure pivotally and rotatably supporting the wheel body parts, at least one wheel being mounted to each respective wheel body part, and the supporting body being connected to the wheel body parts by springs, characterized in that the wheel body parts have side constructions, a stabilizer construction resiliently interconnects the side constructions of the wheel body parts to each other and to the supporting body, the stabilizer construction comprises a reaction bar connected to the supporting body by a supporting link and to the side constructions of the wheel body parts by elastic constructions enabling the movement of the reaction bar in at least all horizontal directions and enabling all side constructions to twist with respect to each other, the reaction bar being disposed between the supporting link and the connecting link which are elastic links, and elastic elements are connected to a compensator.

* * * * *